United States Patent [19]

Merchant

[11] 4,184,304

[45] Jan. 22, 1980

[54] METHOD FOR INSTALLING A FLOOR COVERING OVER METAL DUCTS OR PLATES

[75] Inventor: Hamir D. Merchant, Simpsonville, S.C.

[73] Assignee: Bigelow-Sanford, Inc., Greenville, S.C.

[21] Appl. No.: 898,282

[22] Filed: Apr. 20, 1978

[51] Int. Cl.[2] ..... E04B 5/48

[52] U.S. Cl. ..... 52/746; 52/221; 52/DIG. 4; 156/71

[58] Field of Search ..... 52/DIG. 4, 221, 747, 52/746; 156/71

[56] References Cited

U.S. PATENT DOCUMENTS

| | | | |
|---|---|---|---|
| 3,341,996 | 9/1967 | Jones et al. | 52/DIG. 4 |
| 3,808,760 | 5/1974 | Ward | 52/221 |
| 4,096,347 | 6/1978 | Penczak et al. | 52/221 X |

*Primary Examiner*—Carl D. Friedman

*Attorney, Agent, or Firm*—Burgess, Ryan and Wayne

[57] ABSTRACT

A method for adhesively attaching carpet sections to one or more sheets of flexible permanently magnetized material which are in turn magnetically adherent to underlying metal plates, so as to make it possible to remove the carpet and underlying plate with ease and without distortion or damage to the carpet, while maintaining the pleasing texture and visual effect of the carpet.

3 Claims, 3 Drawing Figures

METHOD FOR INSTALLING A FLOOR COVERING OVER METAL DUCTS OR PLATES

Figure 1:
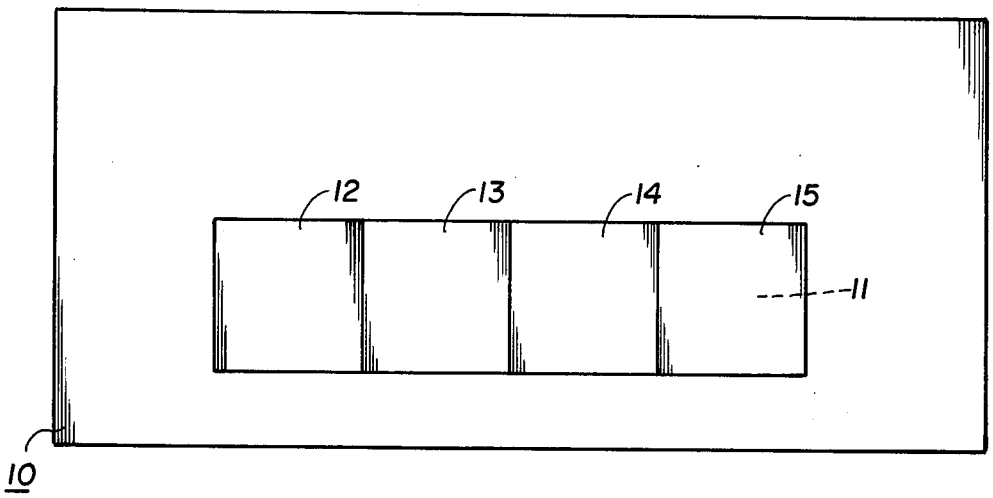

This invention relates to a method for installing a floor covering over a floor having at least one section comprising a magnetically permeable metal.

The floor covering to which this invention relates may be rigid or flexible, but a flexible floor covering is preferred. The invention is most particularly useful in connection with pile fabric floor coverings generally hereafter referred to as carpeting.

The method of the present invention is particularly suitable for floor systems wherein so-called trenches or headers are recessed into the floor. These trenches, or headers, are typically covered with metal plates (of magnetically permeable steel) approximately 1 to 2 ft. wide by 2 to 6 ft. long that fit flush with the regular floor and cover the trenches and headers. The invention is also applicable to use with so-called floating floor systems wherein the floor is composed of metal panels, usually 24 inches square, mounted above a sub-floor with space in between.

In either system mentioned above, the plates are used to cover service wires, busways, telephone cables, plumbing, etc. located below the floor or floating floor and to provide access to the same. The aforementioned floors are increasingly coming into use in such areas as computer rooms, offices having installations of electrical or electronic office equipment or other utilities, and in factory and house areas.

At first, the traditional soft surface pile fabric floor coverings, such as carpets and rugs, were not used with such floor systems, because of the difficulty of removing carpet panels easily and without damage and it was necessary to resort to the use of hard surface floor coveing, even where soft surface floor covering was much desired, and despite the shortcomings of hard surface floors such as high noise, breakage and injury factors, susceptibility to scuffing and increased fatigue to personnel. However, the noise reduction value of carpet, its esthetic appeal, freedom from breakage, and scuffing and other beneficial effects on the comfort of the employees working in these areas has led to the increasing use of carpet with such floor systems.

The carpet is normally adhesively secured to the floor and to the plates that cover the trench or header; or the plates that comprise a floating floor. To provide for access to the wires, plumbing, etc. when necessary work is required, the carpet is cut, either during installation or at the time of the required work, so that each plate will have a separate block or section of carpet adhered to its upper surface, permitting the removal of individual plates and attached carpet without disturbing the rest of the carpet installation.

However, when the panels and carpet are lifted together, the carpet can become distorted, twisted, buckled, etc. and in some instances can be torn completely from a plate causing damage to the carpet. In these cases, even if the carpet can again be adhesively secured to the plate, the floor installation can appear unsightly in the affected area.

Accordingly, an object of the present invention is to provide a method for installing a floor covering which overcomes the difficulties set forth above.

As herein described, there is provided a method for installing a floor covering over a floor having at least one section comprising a magnetically permeable metal, said method comprising the steps of disposing on said section a sheet of flexible permanently magnetized material, so that said material is magnetically adherent to said section; securing said floor covering to said floor so that the portion of said covering over said sheet and said section may be moved away from said section, and securing said floor covering portion to the exposed surface of said magnetized sheet material.

Figure 2:
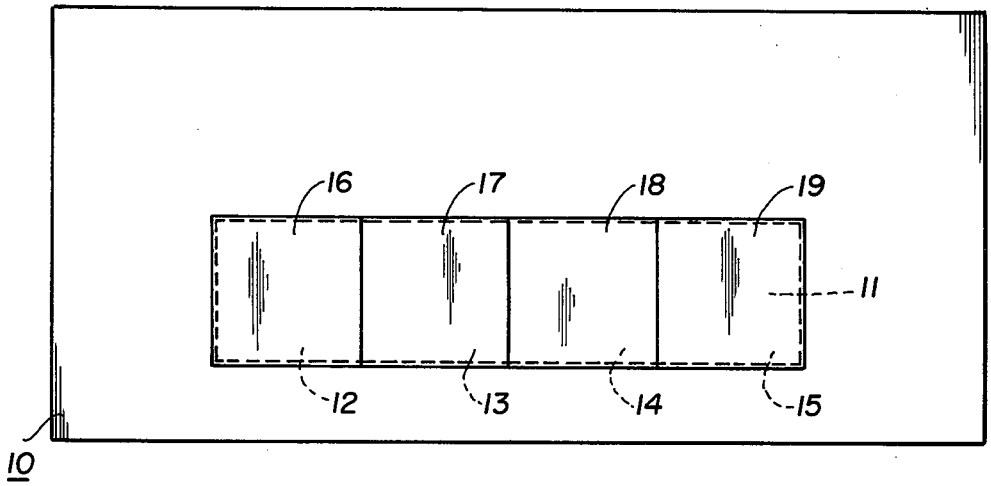
Figure 3:
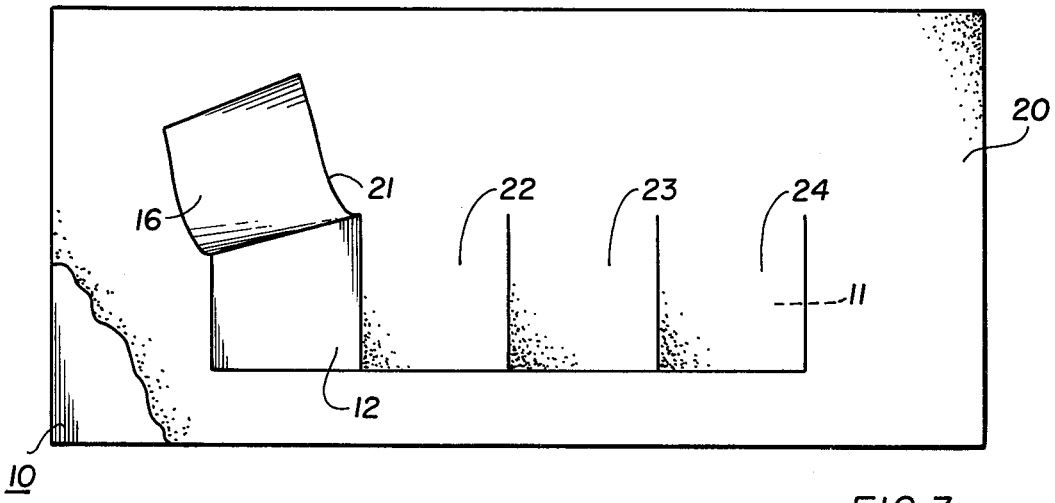

FIGS. 1, 2 and 3 of the drawing illustrate sequential steps in the method according to a preferred embodiment of the invention.

As shown in FIG. 1, a floor 10 comprises a rigid horizontal surface having a rectangular trench 11 therein, in the form of an elongated recess for permitting access to wires, cables, plumbing or other utilities below the floor 10. The trench 11 is covered by four removable metal plates 12, 13, 14 and 15, each comprising a magnetic, magnetically permeable or magnetically attractive sheet, i.e. a material which is substantially unmagnetized and would be magnetically attracted to a permanent magnet.

In covering the floor 10 with a flexible material such as carpeting, it has been conventional practice to cut separate sections of carpeting to fit over the steel plates 12 to 15, and to adhesively secure each piece of carpeting to the corresponding steel plate. However, it has been found that when steel plate is to be removed, the person removing the plate often pulls on the overlying carpet section, resulting in peeling of the carpet from the plate, and sometimes in tearing or distortion of the carpet.

The first step in the method of the present invention is illustrated in FIG. 2, and involves placing sheets 16, 17, 18 and 19 of flexible permanently magnetized magnetic material over the plates 12 to 15 respectively. Although the sheets 16 to 19 are shown in FIG. 2 as being slightly larger than the underlying plates for purposes of clarity, preferably these sheets should be approximately the same size as the corresponding underlying steel plates. The sheets 16 to 19 are retained in contact with the underlying steel plates by magnetic attraction forces.

Flexible permanently magnetized magnetic tape or sheet material suitable for use as the sheets 16 to 19 is manufactured by B. F. Goodrich Company and by 3M Company and others. One of the B. F. Goodrich flexible permanently magnetized magnetic sheet materials is sold under the designation "Flexible Magnetic Sheet 28-47-1030." This material is suitable for both indoor and outdoor usage.

After the flexible magnetic sheets 16 to 19 have been disposed over the corresponding steel plates 12 to 15, the entire floor 10 (including the trench 11) is carpeted in conventional fashion, with carpeting 20. The carpeting 20 is cut along the lines shown in FIG. 3, above the trench 11, so as to provide four flaps 21, 22, 23 and 24 disposed over the flexible magnetic sheets 16 to 19 and underlying steel plates 12 to 15 respectively. Each of the carpet flaps 21 to 24 is adhesively secured to a corresponding one of the underlying flexible magnetic sheets 16 to 19. Thus each of the flaps 21 to 24 is permanently bonded to the corresponding flexible magnetic sheet.

The flaps 21 to 24 are then disposed over the corresponding steel plate, and rolled with a suitable roller to bring the magnetic sheets 16 to 19 into intimate contact with the underlying steel plates 12 to 15 and to remove any air bubbles or pockets therebetween If desired, rather than forming the flaps 21 to 24 so that they remain attached to the carpet 20, said flaps can be cut away from the carpet 20 so that they are in the form of separate carpeting-flexible magnetic sheet composites disposed over the corresponding steel plates.

When it is necessary to gain access to, e.g., the steel plate 12, the corresponding carpet flap 21 is folded back to expose said plate, which can then be readily removed and replaced without damage to the carpeting.

What is claimed is:

1. A method for installing flexible carpeting over a floor having at least one section comprising a magnetically attractive metal, said method comprising the steps of:

disposing on said section a sheet of flexible permanently magnetized magnetic material, so that said material is magnetically adherent to said section;

disposing said carpeting on said floor; and securing the portion of said carpeting over said sheet and said section to the exposed surface of said magnetized sheet material so that the portion of said carpeting over said sheet and said section may be moved away from said section.

2. The method according to claim 1, comprising the additional step of, after said securing steps, rolling said floor covering portion to remove any air bubbles or pockets thereunder.

3. The method according to claim 2, wherein said first-mentioned securing step is carried out so that said floor covering portion remains attached to the adjacent part of said floor covering along a fold line.

* * * * *